US007665473B1

(12) United States Patent
Gueret

(10) Patent No.: US 7,665,473 B1
(45) Date of Patent: Feb. 23, 2010

(54) COMB FOR APPLYING A PRODUCT ON KERATINOUS FIBERS, APPLICATION SET EQUIPPED THEREWITH AND USE OF SAID SET

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/787,409

(22) PCT Filed: May 26, 2000

(86) PCT No.: PCT/FR00/01458

§ 371 (c)(1),
(2), (4) Date: Sep. 17, 2001

(87) PCT Pub. No.: WO01/05274

PCT Pub. Date: Jan. 25, 2001

(30) Foreign Application Priority Data

Jul. 21, 1999 (FR) ..... 99 09451

(51) Int. Cl.
*A45D 40/26* (2006.01)

(52) U.S. Cl. ..... 132/218

(58) Field of Classification Search ..... 132/218, 132/320; 401/129, 126
See application file for complete search history.

(56) References Cited

U.S. PATENT DOCUMENTS

| | | | | |
|---|---|---|---|---|
| 1,833,293 | A * | 11/1931 | Laguionie | 132/111 |
| 1,905,399 | A * | 4/1933 | Wagner | 132/218 |
| 2,175,344 | A * | 10/1939 | Friedman | 132/137 |
| 3,669,130 | A * | 6/1972 | Petroczky | 132/138 |
| 3,763,870 | A | 10/1973 | Montgomery et al. | |
| 4,458,701 | A * | 7/1984 | Holland | 132/218 |
| 5,007,442 | A * | 4/1991 | Hirzel | 132/218 |
| 5,318,051 | A * | 6/1994 | Koppel | 132/126 |
| 5,325,878 | A * | 7/1994 | McKay | 132/116 |
| 5,611,361 | A * | 3/1997 | Leone | 132/218 |
| 5,709,230 | A * | 1/1998 | Miraglia | 132/218 |
| 5,765,573 | A * | 6/1998 | Gueret | 132/218 |
| 6,029,675 | A * | 2/2000 | Dumler | 132/218 |

FOREIGN PATENT DOCUMENTS

| | | |
|---|---|---|
| DE | 25 59 273 | 7/1977 |
| FR | 2 769 805 | 4/1999 |
| JP | 54-23483 | 8/1979 |
| JP | 55-95606 | 7/1980 |
| JP | 58-84012 | 6/1983 |
| JP | 59-111708 | 6/1984 |
| JP | 61-199807 | 9/1986 |
| JP | 2-38925 | 3/1990 |
| JP | 0 474 934 | 3/1992 |

(Continued)

*Primary Examiner*—Robyn Doan
(74) *Attorney, Agent, or Firm*—Oblon, Spivak, McClelland, Maier & Neustadt, L.L.P.

(57) ABSTRACT

The invention concerns a comb (1) for applying a product on keratinous fibres, comprising and arrangement of teeth (2*a*, 3*a*) foe applying said product. The invention is characterized in that said arrangement of teeth is obtained by assembling at least two separate parts (2, 3). The invention also concerns an application set equipped with such comb (1), and its use for applying make-up on eyelashes or eyebrows.

46 Claims, 3 Drawing Sheets

FOREIGN PATENT DOCUMENTS

| | | |
|---|---|---|
| JP | 8-19420 | 1/1996 |
| JP | 9-108033 | 4/1997 |
| JP | 10-502291 | 3/1998 |
| JP | 3057092 | 3/1999 |
| WO | 97/07708 | 3/1997 |
| WO | 99/20146 | 4/1999 |

* cited by examiner

COMB FOR APPLYING A PRODUCT ON KERATINOUS FIBERS, APPLICATION SET EQUIPPED THEREWITH AND USE OF SAID SET

The present invention relates to a comb for applying a product to keratinous fibers, particularly the eyelashes or eyebrows. The invention also relates to a set of the type comprising a container for containing a reserve of product and an applicator comprising a wand equipped with an applicator element in the form of such a comb. A wringing-out member may possibly be provided in the container to spread the product out on the comb and/or to remove any excess product as the applicator element is being extracted.

The invention relates more specifically although not exclusively to a comb for the eyelashes or eyebrows and comprising at least one row of teeth connected to a base of elongate shape.

Packaging and applicator devices in which the applicator element consists of a comb with a row of teeth which can become laden with product when the applicator is extracted from the container containing the product are known.

The implantation of the teeth on the comb is a decisive factor in the applying of the product, particularly to the eyelashes. For a product of given rheology, each implantation corresponds to a make-up effect the characteristics of which differ. Thus, depending on the implantation of the teeth, the make-up effect will be light, heavy, curling, lengthening, etc. Quite obviously there are other factors which influence the product application characteristics, the most important one probably being the product itself.

Such combs are generally obtained by molding, particularly of a thermoplastic. One of the problems that may arise with such combs stems from the difficulty there is in multiplying the types of implantation and thus, as a result of this, in multiplying the types of make-up effect that can be obtained. The problem is that each new implantation of the teeth aimed at obtaining a new make-up effect requires the use of a new mold. Furthermore, the constraints related to mold release have to be accounted for each time.

As a result, there is a need to configure such combs in such a way that the type of implantation of the teeth in the comb can be multiplied and therefore that the types of make-up effect that can be obtained can correspondingly be multiplied. In other words, there is a need to be able to give such combs configurations (tooth implantation) that it would be difficult to obtain with the manufacturing techniques commonly employed.

There is also a need to produce a comb for applying a composition, particularly a cosmetic or care composition, particularly to the eyelashes, and which is easy to manufacture and has repeatable geometry.

Hence, the present invention relates to a comb for applying a product to keratinous fibers, particularly the eyelashes or eyebrows, comprising an arrangement of teeth capable of applying said product. This comb is characterized in particular in that said arrangement of teeth is obtained by assembling at least two separate parts.

The parts advantageously have a configuration such that said arrangement of teeth is not formed until after these parts have been assembled. To that end, each part advantageously comprises at least one portion intended to collaborate with a corresponding portion belonging to another part. Said arrangement of the teeth is thus produced, after the parts have been assembled, on the comb in its final form.

Advantageously, the teeth are arranged in the form of at least one row, and are connected to a base, particularly one of elongate shape, extending along a longitudinal axis. More particularly, a two-part embodiment is preferred.

Thus, and according to the invention, each of the separate parts can, in combination with the other part, play a part in forming all or some of the teeth of one or more rows. As an alternative, a certain number of teeth of one or more rows may be formed on one part while the remainder of the teeth may be formed on the other part.

As a preference, two parts of the arrangement are obtained by molding thermoplastic in a single piece and are joined together pivotably by a film hinge.

Advantageously, said film hinge connects the bases of the two parts. Advantageously also, after molding and once one of the parts has been folded onto the other, the two parts are assembled, for example by snap-fastening, wedging, welding, bonding or by any other appropriate means.

Alternatively, two parts can be obtained by molding thermoplastic in the form of two separate parts which are assembled by snap-fastening, welding, bonding or by any other appropriate means.

As a preference, the two parts are shaped in such a way that, after assembly, the teeth of the two parts are offset in a staggered configuration alternating from side to side of a separation surface consisting, in particular, of a plane along which the two parts meet.

Advantageously, when the comb is viewed along said longitudinal axis, two consecutive teeth of one row have free ends which diverge from one another, which converge toward one another or which even cross one another.

Similarly, when the comb is viewed from the side, two consecutive teeth may have free ends which diverge or which converge to such an extent that they might cross.

Thus, when the comb is viewed from the side, two consecutive teeth form between them a notch, for example a V-shaped notch, capable of gripping the eyelashes and encouraging the product to spread out along the eyelashes with the comb entwined therein.

In order to increase the ability to catch hold of the eyelashes, the teeth may have front and/or rear faces which are parallel to the meeting surface and which form an acute or obtuse angle therewith.

Advantageously, and this is to make the device easier to grip, the comb is secured to an element for grasping connected directly or by means of a wand to the comb. This element for grasping may be connected to the base of the comb from one of the ends of the base, more or less in line with the element for grasping. Alternatively, the arrangement of teeth is oriented at right angles to a longitudinal axis of the element for grasping.

When the comb is assembled by snap-fastening two separate parts, said snap-fastening can be performed using at least one male/female system consisting of two complementary elements, which complementary elements are arranged one on a first part and the other on the second part of the comb.

When the comb comprises a film hinge, the latter is preferably oriented at right angles to said axis of orientation of the teeth. According to this particular embodiment, the film hinge is formed near one face of the base located away from the face on which the teeth are implanted. According to one particular embodiment, the film hinge is located at the bottom of a groove directed axially to said comb.

Alternatively, the film hinge may be oriented at right angles to the longitudinal axis of the comb.

According to one embodiment, the parts may be assembled by said element for grasping, for example by attachment to one end of the two parts which is arranged away from the film hinge.

According to another method of assembling the two parts, the two parts are assembled by the collaboration of the two parts forming the arrangement of teeth and of a portion of the element for grasping, particularly an end portion of the element for grasping.

The height of the teeth can vary. By way of example, the height of these teeth may be between 0.5 and 10 mm.

Depending on the make-up characteristics desired, the comb may be made of a rigid, semi-rigid or soft thermoplastic, for example of an elastomer with an appropriate bending modulus.

Another subject of the invention is a set for applying a product, particularly a cosmetic product, to the eyelashes or eyebrows, comprising a container for containing a reserve of product and possibly fitted with a wringing-out member, and an applicator capable of being fixed, removably, on the container. This set further comprises an element for grasping equipped at one end with a comb as defined hereinabove. An appropriate wringing-out member is described, for example, in document FR-A-2 745 272.

The applicator set of the invention can be used, in particular, for applying make-up to the eyelashes or eyebrows.

The invention will be better understood from reading the detailed description which will follow of non-limiting exemplary embodiments and from examining the appended drawing, in which.

A first embodiment of a comb 1 for applying a product to the eyelashes or eyebrows has been depicted with reference to these figures, particularly to FIGS. 1 to 4. The product intended to be applied is, in particular, a mascara of liquid to pasty consistency.

Figure 1:
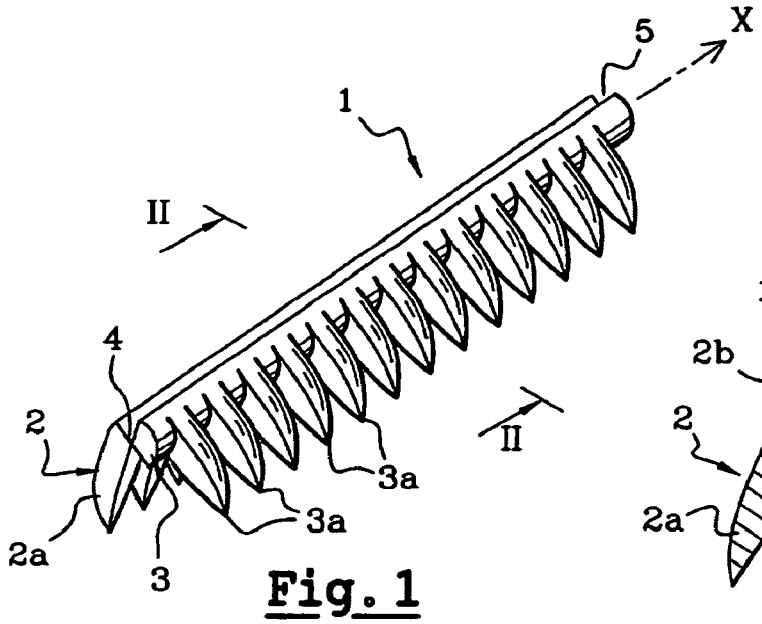
FIG. 1 is a perspective view of an applicator comb 1 according to one embodiment of the invention, shown in the unassembled configuration.
Figure 2:
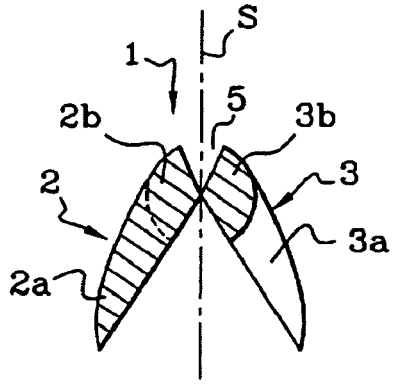
FIG. 2 is a view in cross section on II-II of FIG. 1.

As can be seen in particular in FIGS. 1 and 2, the comb 1 consists of a first part 2 and of a second part 3 of elongate shape and both oriented along an axis X. The two parts 2 and 3 are joined together by a film hinge 4 formed between the respective bases 2*b*, 3*b* of said parts 2, 3. A meeting plane S forms a plane of symmetry between the two parts 2, 3. The bases 2*b*, 3*b* each carry a succession of teeth 2*a*, 3*a*. Thus, a succession of the teeth 2*a* forms a straight row of teeth implanted on the base 2*b* of the part 2. Similarly, a succession of teeth 3*a* forms a straight row of teeth implanted on the base 3*b* of the part 3. The two bases 2*b* and 3*b* constitute the dorsal part of the comb. According to the embodiment considered, the implantation of the teeth 2*a*, 3*a* is such that the teeth 2*a* of the first part 2 alternate with the teeth 3*a* of the second part 3. The edges of the bases away from the edges on which the teeth are implanted are separated by a groove 5 of V-shaped cross section. The point of the V forms said film hinge 4.

Figure 3:
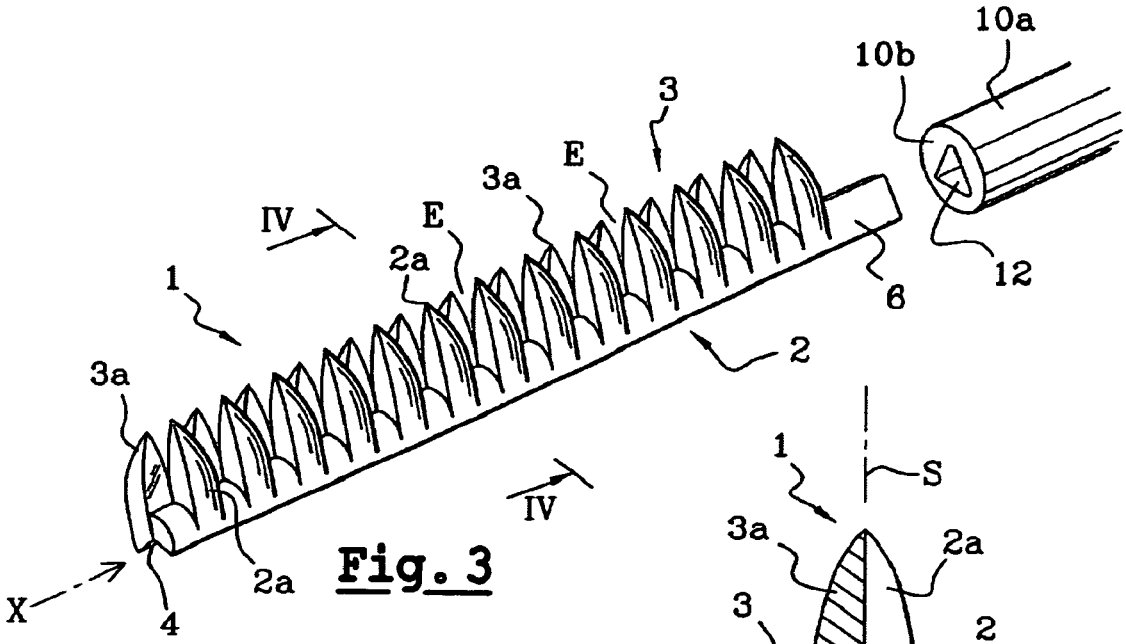
FIG. 3 is a perspective view of the comb of FIG. 1, shown in the assembled configuration.
Figure 4:
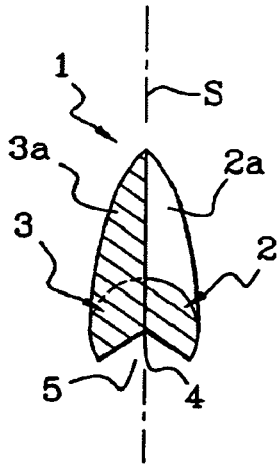
FIG. 4 is a view in cross section on IV-IV of FIG. 3.

The film hinge allows the comb to be released from the mould in the configuration illustrated in FIGS. 1 and 2 and allows the two parts 2, 3 to to be assembled by pivoting about said film hinge 4 to obtain the comb in a configuration for use, as depicted in FIGS. 3 and 4.

In the as-moulded configuration, there is a large gap between the free ends of the teeth 2*a* and the free ends of the teeth 3*a*.

This configuration makes it possible to produce teeth with complex shape and complex implantations on the bases 2*b*, 3*b*, which shapes and implantations would be difficult to achieve if the comb were made of a single piece. Thus, for example, according to the invention, it is possible to produce combs in which the teeth of the first part penetrate between teeth in the row of the second part. It is also possible to produce a first part with teeth inclined in a first direction and a second part with teeth inclined in a second direction different from the first. In particular, it is possible, according to the invention, to produce combs in which the overall orientation of the teeth implanted on the first part is not parallel to the overall orientation of the teeth implanted on the second part.

In order to obtain the comb in the configuration for use, as depicted in FIGS. 3 and 4, once the two parts 2*b*, 3*b* have been brought closer together by pivoting about the axis of the film hinge 4, the first part 2 may be fixed to the second part 3 by bonding, by welding, by snap-fastening or by wedging.

Figure 11:
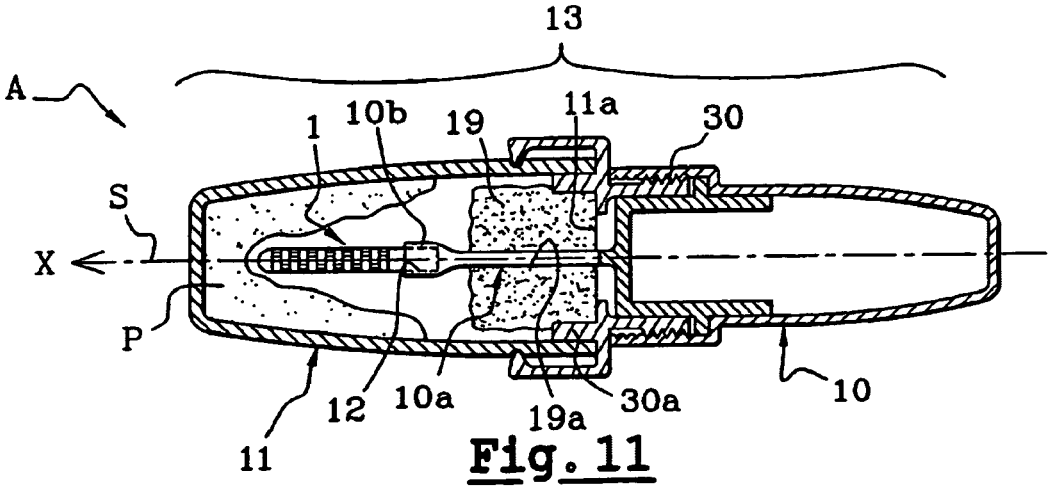
FIG. 11 is a schematic view in axial section of a packing and applicator set A, according to the invention, equipped with the applicator comb 1 according to the embodiment according to FIGS. 3 and 4.

Such wedging is illustrated in FIG. 3. It can be seen that one end of the comb is continued in the form of a portion 6 of triangular cross section. This portion 6 is pushed into a hole 12 of corresponding cross section made in the end 10*b* of a wand 10*a*. This arrangement makes it possible both to assemble the two parts 2, 3 and to connect the comb to a gripping member 10, to which the wand 10*a* is secured (FIG. 11). An applicator 13 that is ready for use is thus formed.

Figure 5:
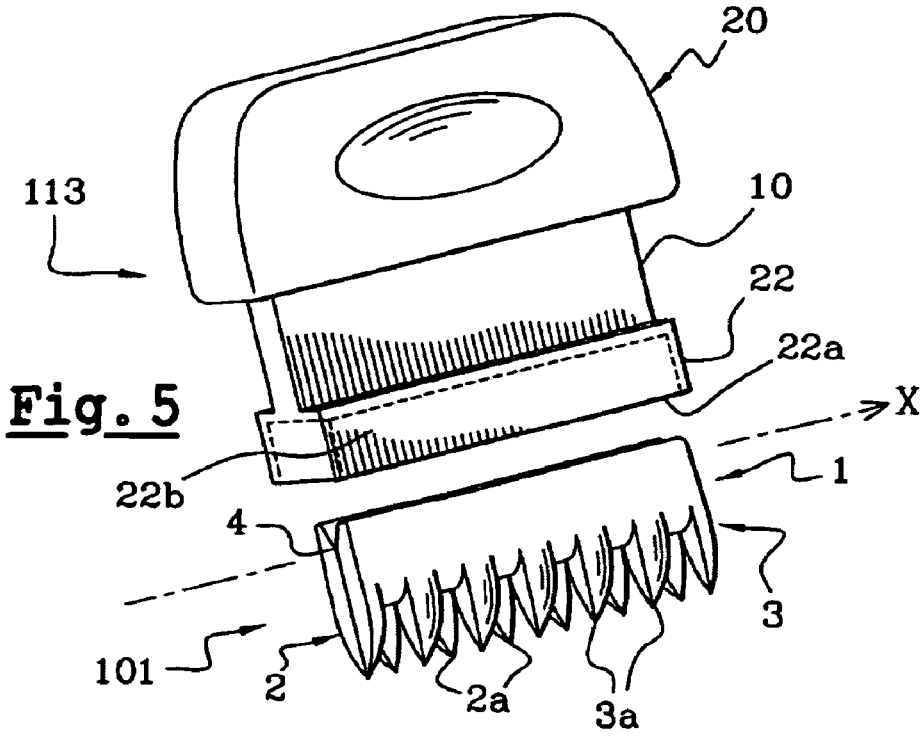
FIG. 5 illustrates another embodiment of an applicator comb 101 according to the invention, while it is in the process of being mounted on an element 20 for grasping.

FIG. 5 illustrates another type of attachment of a comb 101 to an element 20 for grasping to form an applicator 113. The element 20 for grasping has an elongate flattened shape and is connected by means of a flat wand 10 to a parallelepipedal housing 22, one end 22*a* of which is open. The housing 22 is able to accommodate the base of a comb 101. The comb 101 has approximately the same structure as the comb 1 described previously in the assembled configuration with reference to FIG. 3. Hence, the comb 101 is formed by assembling two parts 2, 3, which parts are connected by a film hinge 4. The housing 22 holds the two parts in the assembled configuration and also forms a means of connecting the comb to the element 20 for grasping.

Figure 6:
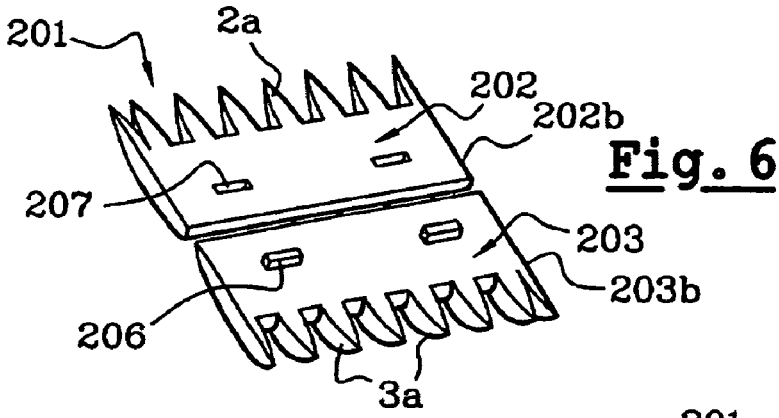
FIGS. 6 and 7 illustrate another embodiment of an applicator comb 201, shown respectively in a configuration before and after assembly.
Figure 7:
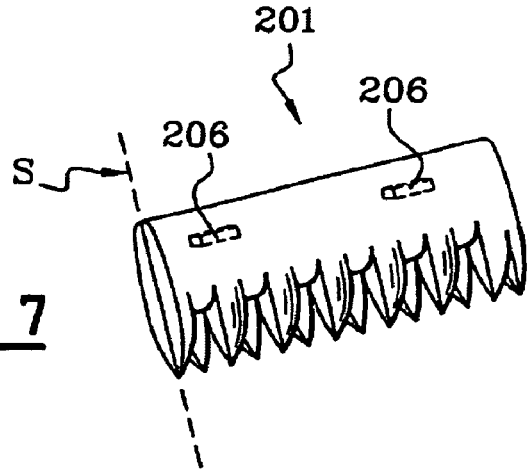

FIG. 6 illustrates another embodiment of an applicator comb 201, in which two parts 202, 203 are molded separately. To allow easy and precise assembly of these two parts, means of mechanical assembly are provided. For this purpose, the base 202*b* of the first part 202 is provided with two openings 207. The base 203*b* of the second part 203 is provided with two pegs 206 capable of fitting tightly into the openings 207 in the first part. The assembly elements may have a profile, for example the shape of a dovetail, that allows a lasting snap-fastening of the two parts 202, 203. FIG. 7 illustrates the comb 201 in its assembled configuration.

Figure 8:
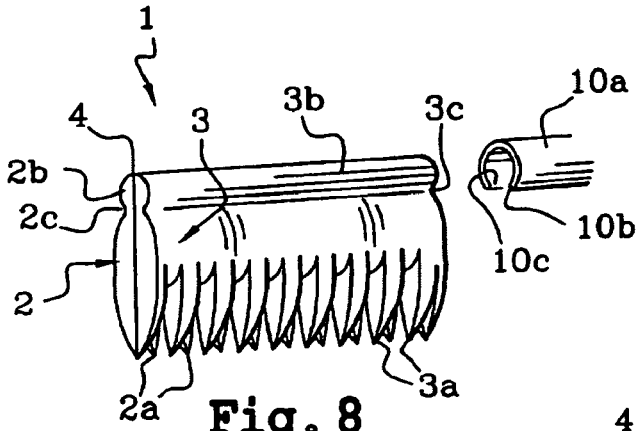
FIGS. 8 and 9 illustrate alternative forms of the applicator comb 1 of FIGS. 1 to 4.

FIG. 8 illustrates another embodiment whereby the comb 1 is assembled by clamping. In this embodiment, the two parts 2, 3 of the comb 1 are connected by a film hinge formed near the dorsal face of the comb 1. Each base 2*b*, 3*b* on its outer face has an indentation 2*c*, 3*c* oriented parallel to the film hinge 4 so as to delimit a portion of the cylinder. A wand 10*a* is designed to hold the two parts 2, 3 in the assembled configuration. For this purpose, the wand 10*a* is hollow and has a longitudinal opening 10*c* so that it forms a channel section delimited by two longitudinal edges 10*b*. This channel section advantageously has a length that more or less corresponds to the axial dimension of the comb. The channel section is shaped in such a way that the cylindrical portion of the bases 2*b*, 3*b* can be slipped inside the channel section 10*c*. The longitudinal edges 10*b* of the channel section are a distance apart that is slightly smaller than the distance defined between the respective bottoms of the two indentations 2*c*, 3*c*, thus allowing the two parts 2, 3 to be held by clamping.

Figure 9:
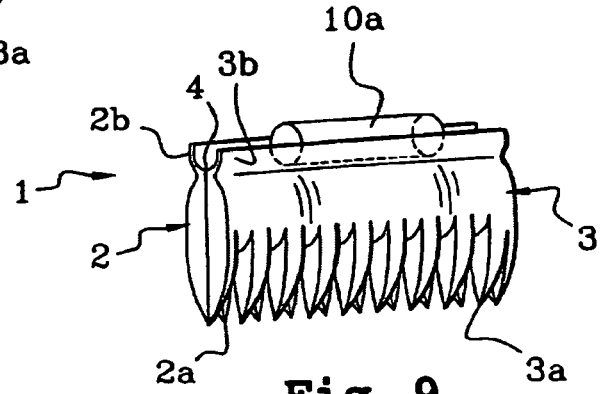

FIG. 9 illustrates another embodiment whereby the comb 1 is assembled by wedging. In this embodiment, the two parts 2, 3 of the comb 1 are connected by a film hinge 4 and each forms a portion of an arc of a cylinder 2*b*, 3*b* located on the portion of the comb 1. These cylindrical-arc portions are located on the opposite side of the teeth 2*a*, 3*a* with respect to the film hinge 4. The cylindrical-arc portions 2*b*, 3*b*, when the comb is in the assembled position, define a channel section extending over an angular extent slightly greater than 180°, thus allowing the free end of a cylindrical wand 10*a* of appropriately chosen diameter to be inserted therein by snap-fastening. Thus, the two parts 2, 3 are kept in the assembled configuration and fixed to an element for grasping carrying the wand 10*a*.

Figure 10:
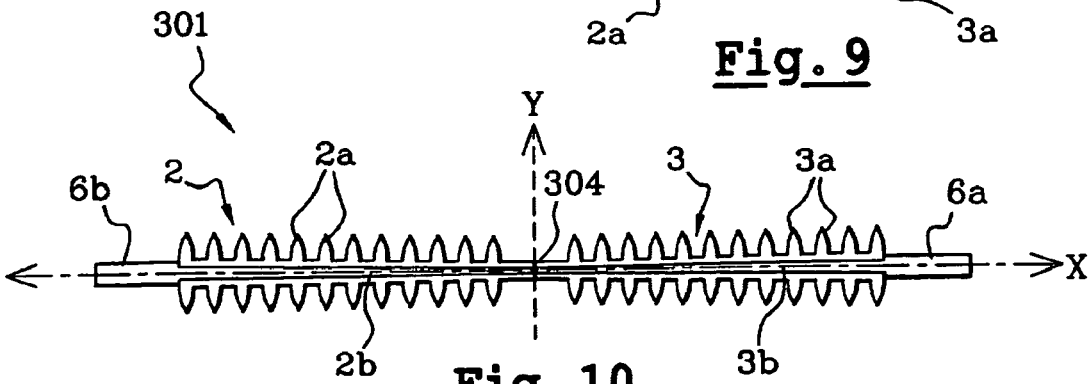
FIG. 10 illustrates another embodiment of an applicator comb 301, shown in the unassembled configuration.

FIG. 10 illustrates another embodiment whereby the parts 2, 3 each comprise a base 2*b*, 3*b* oriented along an axis X. Each base carries a number of teeth 2*a*, 3*a*. The bases 2*b*, 3*b* are connected by a film hinge 304 oriented along an axis Y perpendicular to the axis X. At its free end, each part 2, 3 has an extension 6*a*, 6*b*, the role of which will be explained hereinbelow. To assemble the comb 301, the parts 2, 3 are folded over on themselves by pivoting about the axis Y. In this configuration, the extensions 6*a*, 6*b* face each other. The film hinge 304, when the two parts have been assembled, forms a free end of the comb, the other end being formed by the extensions 6*a*, 6*b*. The assembly of the two parts is consolidated by push-fitting the two ends 6*a*, 6*b* into the free end of a hollow wand, in a similar way to the way described with respect to the embodiment according to FIG. 3.

An applicator set A is depicted in FIG. 11. This set comprises a container 11 containing a reserve of a cosmetic and/or treatment product P for the eyelashes or eyebrows, for example mascara.

The container 11 has a threaded neck 30 onto which an applicator 13 is fitted, removably. The applicator 13 consists of a gripping handle 10 comprising, on the side intended to be fitted onto the container 11, an emerging wand 10*a* of axis X. The gripping handle 10 constitutes a cap for closing the container, designed to be screwed onto the neck 30. The free end 10*b* of the wand 10*a* has a blind bore 12 into which a free end 6 of an applicator comb 1 is fixed. This comb has a configuration more or less similar to the configuration of the applicator comb described previously with reference to FIGS. 1 to 4.

Internally, the opening 11*a* of the container 11 is fitted with a wringing-out member 19 consisting of a block of elastically deformable open-cell or semi-open-cell foam, inserted in an interior portion 30*a* of the neck 30. The block of foam 19 has a central passage 19*a* through which the applicator comb 1 and a portion of the wand 10*a* to which it is secured can pass. The passage 19*a* makes it possible, as the applicator is being extracted from the container, for the product P to be spread out between the teeth of the comb and for any excess product P to be removed.

The wand 10*a* may be rigid or semi-rigid. It has been depicted as being straight but other alternatives could be curved.

Of course, the invention is not restricted to the exemplary embodiments which have just been described, and the embodiment particulars of the various exemplary embodiments which have just been described could, in particular, be combined with one another.

The comb may be made of more than two parts, thus making it possible to produce a comb with three or four rows of teeth, or even more.

The teeth may have a height which varies according to the axial position along the applicator element, for example a height which increases, decreases, decreases then increases or increases then decreases, from front to back.

The teeth may have a surface finish that makes it possible to increase the amount of product with which the comb can be laden; the teeth may thus have capillary grooves. Furthermore, at least one portion of at least one of the parts of the comb may be provided with flocking.

If appropriate, as the parts intended to form the comb are being assembled, a layer of absorbent material may be inserted between two or more of the parts. This arrangement makes it possible to increase the product absorption and improve the spreading of the product along the eyelashes or eyebrows. Such a layer of absorbent material is chosen, for example, from open-cell or semi-open-cell foams, felts, wovens and nonwovens. The thickness of such an absorbent layer may preferably be in a range between 0.1 mm and 1 mm.

The teeth may be covered with a coating such as a varnish, for example, intended to confer on them better ability to glide along the eyelashes, or, on the other hand, greater roughness. Alternatively, the thermoplastic may contain an appropriate quantity of agents intended to improve the slip along the keratinous fibers, such as graphite, molybdenum disulfide or Teflon.

The eyelash or eyebrow applicator comb of the invention is preferably made by the injection-molding of a thermoplastic, of more or less rigid or semi-rigid consistency or made of elastomer, particularly a thermoplastic elastomer of appropriate flexibility. The parts of which the comb is made may be made of different materials.

The invention claimed is:

1. A comb for applying a product to keratinous fibers, comprising:

an arrangement of teeth capable of applying said product, wherein said arrangement of teeth is obtained by assembling at least two parts, and wherein, after assembling, said at least two parts comprise a first part with teeth inclined in a first direction and a second part with teeth inclined in a second direction different from said first direction, and the two parts are joined together pivotably by a film hinge, wherein an inner edge of each of said teeth of said first part lies in a same plane as an inner edge of each of said teeth of said second part, wherein the teeth of said first part are offset in a staggered configuration relative to the teeth of said second part, and wherein, after assembling, said teeth of one of said two parts have ends which converge toward ends of said teeth of another of said two parts.

2. The comb as claimed in claim 1, wherein at least one of the parts comprises a succession of teeth configured in the form of at least one row connected to a base of elongate shape extending along an axis.

3. The comb as claimed in claim 2, wherein when viewed perpendicularly to the axis, two consecutive teeth form between them a notch.

4. The comb as claimed in claim 1, wherein the comb is secured to an element for grasping.

5. The comb as claimed in claim 1, which comprises a means capable of consolidating the assembly of the two parts.

6. The comb as claimed in claim 1, wherein the parts are made of different materials.

7. The comb as claimed in claim 1, wherein at least one portion of at least one of the parts is covered in flocking.

8. The comb as claimed in claim 1, wherein said arrangement of teeth is capable of applying said product to at least one of eyelashes and eyebrows.

9. The comb as claimed in claim 1, wherein bases of two consecutive teeth form between them a V-shaped notch.

10. The comb as claimed in claim 1, wherein said hinge film has an axis that lies in said same plane of each of said inner edges of said first and second parts.

11. The comb as claimed in claim 1, wherein each of the teeth of said first and second parts have a curved outer edge that meets said inner edge at said same plane.

12. A comb for applying a product to keratinous fibers comprising:

an arrangement of teeth capable of applying said product, wherein said arrangement of teeth is obtained by assembling at least two parts along an axis, wherein the two parts are formed of a single piece of a molded thermoplastic material and the two parts are joined together pivotably by a film hinge, wherein each of the teeth of said two parts has at least part of an edge that lies in a same plane as an axis of said film hinge, wherein the teeth of one of said two parts are offset in a staggered configuration relative to the teeth of another of said two parts, and wherein, after assembling, said teeth of one of said two parts have ends which converge toward ends of said teeth of another of said two parts.

13. The comb as claimed in claim 12, wherein the film hinge is oriented parallel to the axis of the arrangement.

14. The comb as claimed in claim 12, wherein the thermoplastic comprises at least one of graphite, molybdenum disulfide, and Teflon.

15. A comb as claimed in claim 12, wherein said comb further comprises a layer of absorbent material inserted between the two parts.

16. The comb as claimed in claim 15, wherein said absorbent material is chosen from open-cell or semi-open-cell foams, felts, wovens and nonwovens.

17. The comb as claimed in claim 12, wherein said teeth of said two parts are connected to an elongated base extending along an axis, and wherein when viewed along the axis, two consecutive teeth have free ends which diverge.

18. The comb as claimed in claim 12, wherein said teeth of said two parts are connected to an elongated base extending along an axis, and wherein when viewed along the axis, two consecutive teeth have free ends which converge and end on said same plane.

19. The comb as claimed in claim 12, wherein said teeth of said two parts are connected to an elongated base extending along an axis, and wherein when viewed along the axis, two consecutive teeth have free ends which cross each other.

20. A comb for applying a product to keratinous fibers, comprising:

an arrangement of teeth capable of applying said product, wherein said arrangement of teeth includes at least two parts along an axis, wherein the two parts are formed by a single piece of thermoplastic and are joined together pivotably by a film hinge, and wherein the film hinge is oriented at a right angle to the axis of the arrangement, wherein each of the teeth of said two parts has at least part of an edge that lies in a same plane as an axis of said film hinge, wherein the teeth of one of said two parts are offset in a staggered configuration relative to the teeth of another of said two parts, and wherein, after assembling, said teeth of one of said two parts have ends which converge toward ends of said teeth of another of said two parts.

21. The comb as claimed in claim 20, further comprising an element for grasping said comb, and wherein the comb is fixed to said element for grasping by an end located away from the film hinge.

22. A set for applying a product, comprising:

a container for containing a reserve of product, and an applicator capable of being arranged removably on the container, said applicator comprising an element for grasping equipped with a comb for applying a product to keratinous fibers, comprising:

an arrangement of teeth capable of applying said product, wherein said arrangement of teeth is obtained by assembling at least two parts, and wherein, after assembling, said at least two parts comprise a first part with teeth inclined in a first direction and a second part with teeth inclined in a second direction different from said first direction, and the two parts are joined together pivotably by a film hinge, wherein an inner edge of each of said teeth of said first part lies in a same plane as an inner edge of each of said teeth of said second part, and wherein the teeth of said first part are offset in a staggered configuration relative to the teeth of said second part.

23. The use of a set as claimed in claim 22 for applying make-up to the eyelashes or eyebrows.

24. The comb as claimed in claim 22, wherein said product is a cosmetic product.

25. The comb as claimed in claim 24, wherein said product is for eyelashes or eyebrows.

26. The comb as claimed in claim 22, wherein said container is fitted with a wringing-out member.

27. A comb for applying a cosmetic product, comprising:

a first part with a first succession of teeth connected to a first elongated base having an end free of teeth;

a second part with a second succession of teeth connected to a second elongated base having an end free of teeth; and a wand having a hole with a cross-section, wherein said first part is coupled to said second part so that said ends free of teeth of said first and second elongated bases form a base portion having said cross section so that said base portion fits into said hole of said wand, wherein the first and second parts are joined together pivotably by a film hinge, and wherein an inner edge of each of said teeth of said first part lies in a same plane as an inner edge of each of said teeth of said second part, and wherein the teeth of said first part are offset in a staggered configuration relative to the teeth of said second part.

28. The comb as claimed in claim 27, wherein, after assembling, said teeth of one of said two parts have ends which diverge from ends of said teeth of another of said two parts.

29. The comb as claimed in claim 27, wherein, after assembling, said teeth of one of said two parts have ends which converge toward ends of said teeth of another of said two parts.

30. The comb as claimed in claim 27, wherein, after assembling, said teeth of one of said two parts have ends which cross ends of said teeth of another of said two parts.

31. The comb as claimed in claim 27, wherein said cross-section is triangular.

32. The comb as claimed in claim 27, wherein said first elongated base and said second elongated base are in contact with each other over an entire length over which said first and second succession of teeth extend.

33. A comb as claimed in claim 27, wherein said base portion extends at least over an entire length over which said first and second succession of teeth extend.

34. The comb as claimed in claim 33, wherein said cross-section is parallelepiped in shape.

35. A comb as claimed in claim 27, wherein said first and second elongated bases are in contact with each other at least over an entire length over which said first and second succession of teeth extend.

36. A comb for applying a product to keratinous fibers, comprising:

an arrangement of teeth capable of applying said product, wherein said arrangement of teeth is obtained by assembling at least two parts, and wherein, after assembling, said at least two parts comprise a first part with teeth inclined in a first direction and a second part with teeth inclined in a second direction different from said first direction, and the two parts are joined together pivotably by a film hinge, wherein an inner edge of each of said teeth of said first part lies in a same plane as an inner edge of each of said teeth of said second part, and wherein the teeth of said first part are offset in a staggered configuration relative to the teeth of said second part, said comb further comprising a gripping member connected to a wand, said wand having an end defining a hole, and wherein the assembled at least two parts form an end portion that is free of teeth, said end portion having a cross-section shape corresponding to said hole of said wand such that said end portion fits into said hole and such that said at least two parts are connected to said gripping member.

37. The comb as claimed in claim 36, wherein said wand, said gripping member and said arrangement of teeth are aligned with each other along a common axis.

38. A comb for applying a product to keratinous fibers comprising:

an arrangement of teeth capable of applying said product, wherein said arrangement of teeth is obtained by assembling at least two parts along an axis, wherein the two parts are formed of a single piece of a molded thermoplastic material and the two parts are joined together pivotably by a film hinge, wherein each of the teeth of said two parts has at least part of an edge that lies in a same plane as an axis of said film hinge, and wherein the teeth of one of said two parts are offset in a staggered configuration relative to the teeth of another of said two parts, said comb further comprising a grasping element connected to a wand, said wand having an end defining a hole, and wherein the assembled at least two parts form an end portion that is free of teeth, said end portion having a cross-section shape corresponding to said hole of said wand such that said end portion fits into said hole and such that said at least two parts are connected to said grasping member.

39. The comb as claimed in claim 38, wherein only a portion of said hinge is located inside said hole of said wand and a rest of said hinge is located outside said wand.

40. The comb as claimed in claim 38, wherein an entirety of said hinge is located inside said hole of said wand.

41. A set for applying a product, comprising:

a container for containing a reserve of product, and an applicator capable of being arranged removably in the container, said applicator comprising an element for grasping equipped with a comb comprising an arrangement of teeth capable of applying said product, said arrangement of teeth being obtained by assembling at least two distinct parts that are different in shape from each other such that said parts are not mirror images of each other, and wherein after assembling, said at least two parts comprise a first part with teeth inclined in a first direction and a second part with teeth inclined in a second direction different from said first direction, and the two parts are joined together pivotably by a film hinge.

42. A set for applying a product as claimed in claim 41, wherein said first part is linear such that the teeth of the first part are inclined in a first linear direction and the second part is linear such that the teeth of the second part are inclined in a second linear direction, and the two linear parts are joined together pivotably by the film hinge.

43. A set for applying a product as claimed in claim 42, wherein an overall orientation of the teeth on the first linear part is not parallel to an overall orientation of the teeth on the second linear part.

44. A set for applying a product as claimed in claim 43, wherein each teeth of said first linear part has a root connected to said first linear part and a tip away from said root and each teeth of said second linear part has a root connected to said second linear part and a tip away from said root; wherein, after assembly, each tooth from the first linear part is adjacent to a tooth from the second linear part so as to form pairs of adjacent teeth; and wherein roots of the pairs of adjacent teeth are adjacent to each other and tips of the pairs of adjacent teeth are away from said roots.

45. A set for applying a product as claimed in claim 41, further comprising a fixing mechanism that maintains the two parts fixed to each other in a position relative to each other such that the teeth are inclined in said first and second directions, wherein said fixing mechanism is distinct from the film hinge.

46. A set for applying a product as claimed in claim 45, wherein said fixing mechanism includes at least one of a snap-fastening mechanism, a wedging mechanism, a welding mechanism or a bonding mechanism.

* * * * *